US008671480B1

(12) United States Patent
Leach

(10) Patent No.: US 8,671,480 B1
(45) Date of Patent: Mar. 18, 2014

(54) MULTI-PURPOSE PILLOW SYSTEM

(76) Inventor: Jamie S. Leach, Ada, OK (US)

( * ) Notice: Subject to any disclaimer, the term of this patent is extended or adjusted under 35 U.S.C. 154(b) by 822 days.

(21) Appl. No.: 11/849,431

(22) Filed: Sep. 4, 2007

(51) Int. Cl.
*A47C 20/00* (2006.01)

(52) U.S. Cl.
USPC ..... 5/632; 5/631; 5/633; 5/655; 5/630; 5/922

(58) Field of Classification Search
USPC ..... 5/631, 632, 633, 655, 630, 922, 636
See application file for complete search history.

(56) References Cited

U.S. PATENT DOCUMENTS

| | | | | |
|---|---|---|---|---|
| 2,351,849 | A * | 6/1944 | Wells et al. | 4/520 |
| 2,857,957 | A | 10/1958 | Gay | |
| 3,009,172 | A * | 11/1961 | Eidam | 5/632 |
| 3,469,882 | A | 9/1969 | Larsen | |
| 3,775,785 | A | 12/1973 | Mittendorf | |
| 4,027,888 | A | 6/1977 | Wilcox | |
| 4,171,549 | A | 10/1979 | Morrell et al. | |
| 4,194,254 | A | 3/1980 | Torrez | |
| 4,393,530 | A | 7/1983 | Stark | |
| 4,506,396 | A | 3/1985 | Ritchie, Jr. et al. | |
| 4,550,459 | A | 11/1985 | Endel et al. | |
| 4,654,907 | A | 4/1987 | Haugaard | |
| 4,685,163 | A | 8/1987 | Quillen et al. | |
| 4,796,315 | A | 1/1989 | Crew | |
| D299,988 | S | 2/1989 | Parabita | |
| 4,826,208 | A | 5/1989 | Ozmar | |
| 4,834,459 | A | 5/1989 | Leach | |
| 4,861,109 | A | 8/1989 | Leach | |
| 4,905,330 | A | 3/1990 | Jacobs | |
| D309,018 | S | 7/1990 | Leach | |
| 4,970,742 | A | 11/1990 | Keener | |
| 4,987,625 | A | 1/1991 | Edelson | |
| D318,202 | S | 7/1991 | Weber | |
| 5,103,514 | A | 4/1992 | Leach | |
| 5,165,130 | A | 11/1992 | Wendling | |
| 5,179,741 | A | 1/1993 | Book | |
| 5,193,238 | A | 3/1993 | Clute | |
| 5,205,611 | A | 4/1993 | Stephens | |
| 5,216,772 | A | 6/1993 | Clute | |
| 5,269,323 | A | 12/1993 | Krouskop | |
| 5,272,780 | A | 12/1993 | Clute | |
| 5,310,245 | A | 5/1994 | Lyszczasz | |
| 5,325,818 | A | 7/1994 | Leach | |
| 5,341,531 | A | 8/1994 | Straub et al. | |
| 5,439,008 | A | 8/1995 | Bowman | |
| D369,054 | S | 4/1996 | Straub et al. | |
| D369,934 | S | 5/1996 | Straub et al. | |
| 5,826,287 | A | 10/1998 | Tandrup | |

(Continued)

*Primary Examiner* — Robert G Santos
*Assistant Examiner* — David E Sosnowski
(74) *Attorney, Agent, or Firm* — Mary M. Lee

(57) ABSTRACT

A multi-purpose pillow system. The pillow system comprises a pair of compressible, shape-sustaining pillows. One pillow is wedge-shaped with a knife-edge on its inner side. The second pillow has a broad flat bottom, so that it can maintain an upright position when standing alone, and an inwardly curved top. The system includes a connecting strap by which one of the pillows is removably and adjustably connected to the other. In this way, the distance between the pillows can be changed to suit the size of the user. When joined by the strap, the pair of pillows provides both back and abdominal support for a pregnant woman or can be used as back support for a sleeping infant. The second pillow with its curved top performs well as a nursing pillow or as a lap tray for an adult or child.

10 Claims, 5 Drawing Sheets

(56) References Cited

U.S. PATENT DOCUMENTS

| | | | | |
|---|---|---|---|---|
| D408,676 | S | 4/1999 | Straub et al. | |
| D422,829 | S | 4/2000 | Kritzinger | |
| 6,049,929 | A | 4/2000 | Rawson | |
| 6,079,067 | A | 6/2000 | Becker et al. | |
| 6,170,908 | B1 * | 1/2001 | Jewell | 297/118 |
| D443,461 | S | 6/2001 | Hall et al. | |
| D444,981 | S | 7/2001 | Hall et al. | |
| D446,675 | S | 8/2001 | Straub | |
| D446,676 | S | 8/2001 | Mayes | |
| 6,343,727 | B1 | 2/2002 | Leach | |
| 6,427,251 | B1 | 8/2002 | Leach | |
| 6,499,164 | B1 | 12/2002 | Leach | |
| 6,553,590 | B1 | 4/2003 | Leach | |
| 6,601,252 | B1 | 8/2003 | Leach | |
| 6,708,354 | B1 | 3/2004 | Carter et al. | |
| 6,735,798 | B1 | 5/2004 | Sekizawa | |
| 6,751,817 | B1 | 6/2004 | Leach | |
| 6,760,934 | B1 | 7/2004 | Leach | |
| 6,848,130 | B1 | 2/2005 | Wilson | |
| 6,886,201 | B1 * | 5/2005 | Weiss-Lohrei | 5/631 |
| 7,000,766 | B2 | 2/2006 | Matthews Brown et al. | |
| 7,010,821 | B1 | 3/2006 | Leach | |
| 7,020,918 | B1 * | 4/2006 | Tinsley | 5/632 |
| 7,114,206 | B2 | 10/2006 | Leach | |
| D565,131 | S | 3/2008 | Decker | |
| 7,353,552 | B2 | 4/2008 | Leach | |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0277321 | A1 | 12/2007 | Leach | |

* cited by examiner

MULTI-PURPOSE PILLOW SYSTEM

FIELD OF THE INVENTION

The present invention relates generally to support pillows.

BACKGROUND OF THE INVENTION

A wide assortment of pillows and cushions are available to serve a variety of needs for adults and children of all ages. Back support pillows are designed to support the back of an adult while sitting or reclining. Curved lap pillows are available for use by mothers and caregivers to support infants while feeding or nursing. Some pillows are designed to support a sleeping infant on his side. Cushioned lap trays are available for use by children and adults. However, there is a continuing need for a more convenient and versatile pillow system that will serve multiple purposes.

DETAILED DESCRIPTION OF THE PREFERRED EMBODIMENTS

Figure 1:
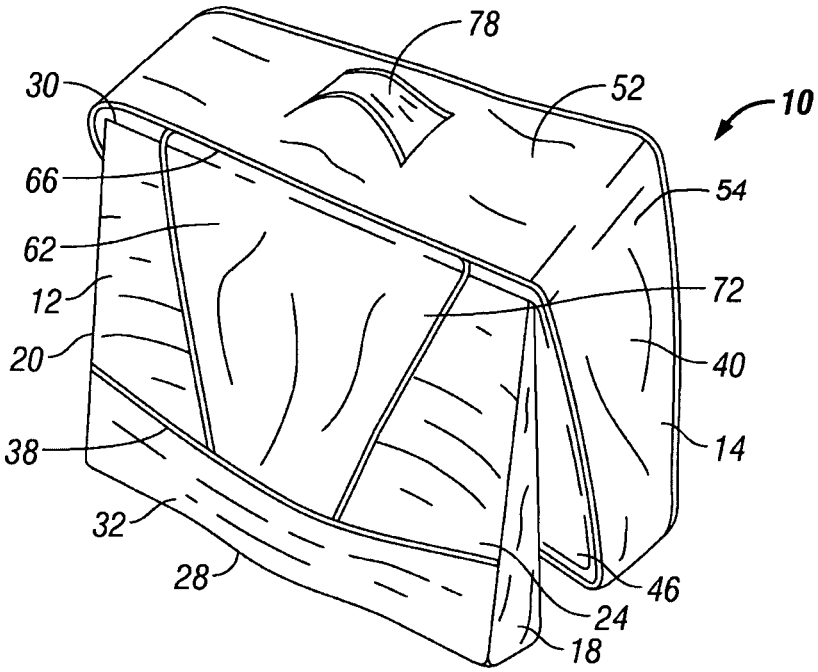
FIG. 1 is a perspective view of a pillow system made in accordance with the present invention. The pillow system is shown in the storage/carrying mode.

The present invention comprises a pillow system with multiple uses for both adults and children. The pillow system comprises a pair of compressible, shape-sustaining pillows or cushions. One pillow is wedge-shaped with a knife-edge on its inner side. The second pillow has a broad flat bottom that allows the pillow to remain in an upright position and to support the user's back. The top of the second pillow has an inwardly extending curve; this feature allows the pillow to serve alternately as a nursing pillow or as a lap tray for an adult or child. Indeed, each of the pillows can be used separately in different ways.

A connecting strap is included to removably and adjustably connect the two pillows together in a cradle configuration. In this mode, the system provides a cradling effect for a pregnant woman while sleeping on her side; the first pillow supports her abdomen, while the second pillow supports her back. This same cradle configuration also provides an infant sleeping pillow for supporting an infant in a side-lying position. These and other advantages will be apparent from the following description of the preferred embodiment.

Turning now to the drawings in general and to FIGS. 1-6 in particular, there is shown therein a multi-purpose pillow system made in accordance with a preferred embodiment of the present invention and designated generally by the reference numeral 10. The pillow system 10 comprises first and second compressible, shape-sustaining pillows 12 and 14.

The first pillow 12 is generally wedge-shaped, that is, it is defined by opposing first and second triangular end panels 18 and 20 joined by top and bottom panels 22 and 24 that converge from an outer side panel 28 to a knife-edged inner side 30. In most instances, the end panels 18 and 20, the top and bottom panels 22 and 24, and the outer side panel 28 are all generally flat or planar. The preferred dimensions of the first pillow 12 may vary, but a convenient size is about 17 inches wide by about 13 inches long with a maximum width at the outer side panel 28 of about 3 inches. "Knife-edged" as used herein, denotes that the edge of the inner side 30 is nearly flat, that is, thin enough that it is comfortable for a person, including a very young infant, to roll over it.

Figure 4:
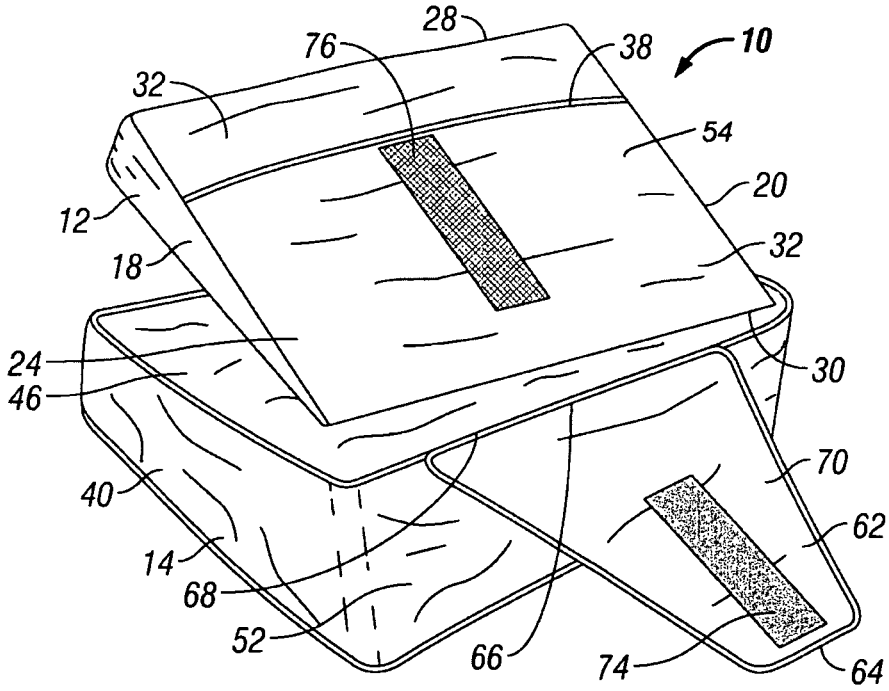
FIG. 4 is a perspective view of the pillow system showing the connecting strap opened.
Figure 5:
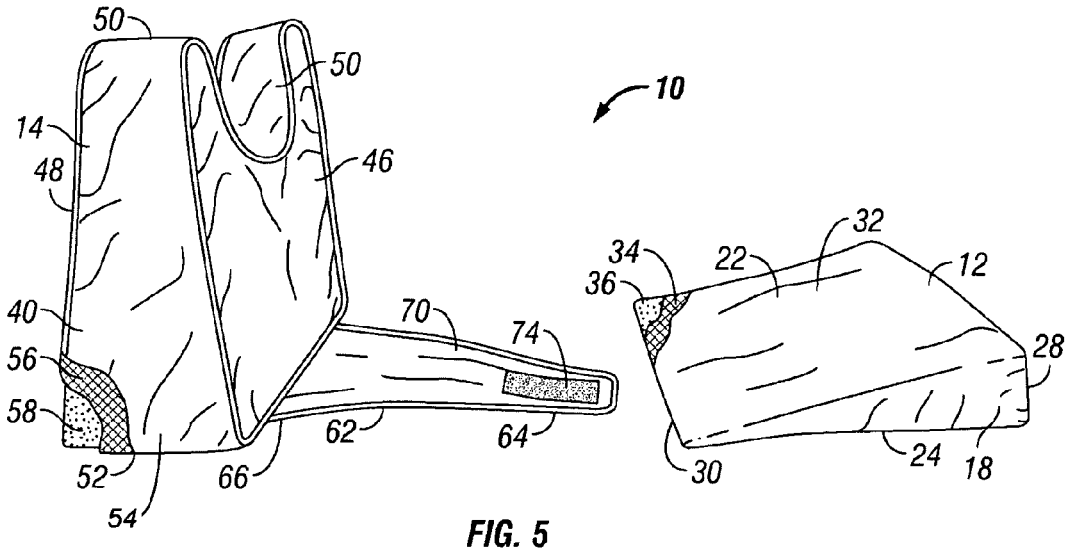
FIG. 5 is another perspective view of the pillow system with the two pillows separated.

Preferably, as shown in FIG. 5, the pillow 12 comprises an insert enclosed in a removable cover 32. The insert typically comprises a fabric enclosure 34 containing a compressible and shape-sustaining filler, such as solid block of firm polyurethane foam 36 in the desired shape. The cover 32 may be provided with an opening, such as the slit 38 in the bottom panel 24 (FIGS. 1, 2 & 4), through which the insert may be inserted and withdrawn. Other closures may used, such as zippers, hook-and-loop fasteners, snaps, ties, hooks, and the like.

The second pillow 14 is defined by opposing first and second end panels 40 and 42 joined by inner and outer side panels 46 and 48, a top panel 50, and a bottom panel 52. The top panel 50 preferably is inwardly curved, for reasons that will become apparent. The bottom panel 52 is flat or planar and is dimensioned to maintain the second pillow in an upright position when the pillow is standing alone, as seen best in FIG. 5.

In most cases, the second pillow 14 will be thicker than the first pillow 12. Although the shape and dimensions may vary, a preferred shape has a width of about 18 inches and a length (top to bottom as in FIG. 6) of about 14.5 inches. The shape and depth of the inward curve in the top panel 50 may vary. Preferably, the depth of the curve is from about ten percent (10%) to about fifty percent (50%) the length of the pillow 14, and more preferably the curve is about twenty percent (20%) to about forty percent (40%) of the pillow's overall length. Most preferably, the curve's depth is about thirty-three percent (33%), or one-third, of the pillow's length. Thus, in the illustrated embodiment, the curve extends inward or downward about 5 inches, that is, the length (top to bottom) of the pillow at the center of the curve is about 9.5 inches. The thickness of the second pillow 14 usually will be slightly wider at the bottom than it is at the top, or about 6 inches wide near the bottom panel 52 to about 3 inches at the top panel 50.

With these dimensions, it is possible to provide one side of the second pillow 14 with a slightly greater slant or pitch than the other side. For example, in the most preferred practice of this invention, the angle formed by plane of the inner side panel 46 relative to the plane of the bottom panel 52 is greater than the angle formed by the plane of the outer side panel 48 relative to the bottom panel.

As with the pillow 12, the second pillow 14 also preferably comprises an insert enclosed in a removable cover 54. As shown in FIG. 5, the insert typically comprises a fabric enclosure 56 containing a compressible and shape-sustaining filler, such as solid block of firm polyurethane foam 58 in the desired shape. The cover 54 may be provided with an opening, such as the zippered slot 60 (FIG. 3) in the outer side panel 48, through which the insert may be inserted and withdrawn. Other closures may used, such as a simple "sham style" overlapping edge, hook-and-loop fasteners, snaps, ties, hooks, and the like.

The fabric of the inserts of the pillows 12 and 14 may be any suitable fabric, including but not limited to waterproof nylon, flannel, or elastic fabrics, such as spandex or cotton-spandex blends. However, presently a polyester/cotton blend is preferred. A preferred filler material for the inserts is firm polyurethane foam. Other suitable fillers include down feathers, memory foam, and polystyrene pellets. Alternately, the insert could be an inflatable enclosure. The covers 32 and 54 may be made of material that is the same as or similar to that used for the inserts. Of course, it should be soft and flexible and washable.

Referring still to FIGS. 1-6, the pillow system 10 further comprises a strap 62 with a first end 64 connected to the first pillow 12 and a second end 66 connected to the second pillow 14. As it is desirable in some applications to separate the pillows 12 and 14, it will be preferable for the strap 62 to be removably connected to at least one of the pillows. The size and shape of the strap 62 may vary, but in the embodiment shown, the strap is about 13-14 inches long and tapers from its widest second end 66 of about 12 inches down to about 3 inches at its narrower first end 64.

It is also advantageous to be able to selectively position the first pillow 12 position relative to the second pillow 14, to adjust for size of the user. To that end, the strap 62 may be adjustably connectable to at least one of the pillows 12 and 14. Thus, in the embodiment illustrated in the drawings, the second end 66 of the strap 62 is permanently connected to the second pillow 14, and the first end is removably and adjustably connected to the first pillow 12.

The second end 66 of the strap may be attached to the second pillow 14 by any suitable method. However, it is convenient to simply sew the edge of the second end 66 into the seam 68 on the cover 54, as best shown in FIG. 4.

The strap 62 has a top surface 70 and a bottom surface 72. Referring still to FIG. 4, in the preferred embodiment, a first fastener, such as an elongate strip 74 of hook-and-loop fastener, is affixed lengthwise along the first end 64. A second fastener engageable with the first fastener 74, such as a mating strip 76 of hook-and-loop fastener, is fixed to the bottom panel 24 of the first pillow 12. Thus, by releasing and reengaging the hook-and-loop fasteners 74 and 76, the distance between the first and second pillows 12 and 14 is adjustable. Alternately, the fasteners could be ties, buttons, snaps, hooks, or the like.

Figure 2:
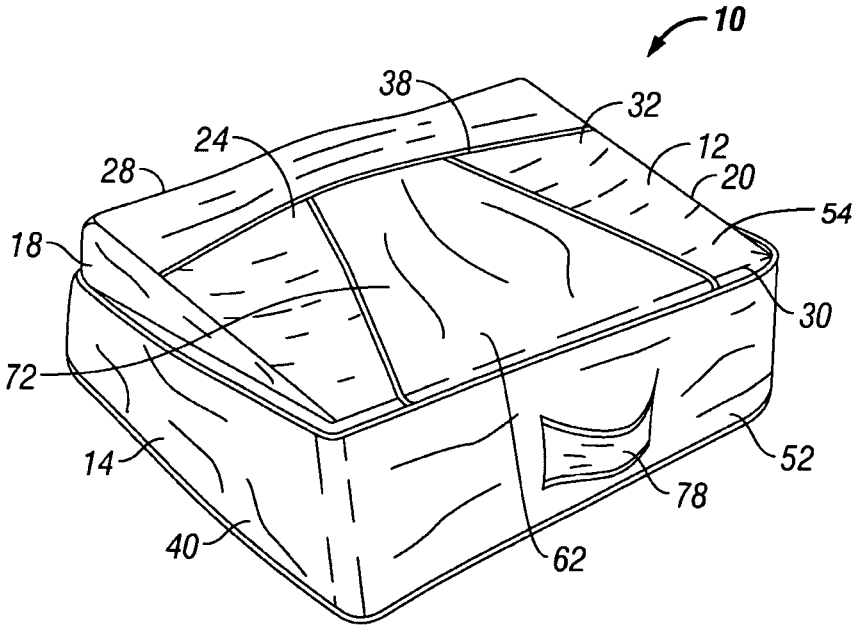
FIG. 2 is another perspective view of the pillow system of FIG. 1, also in the storage/carrying mode.
Figure 3:
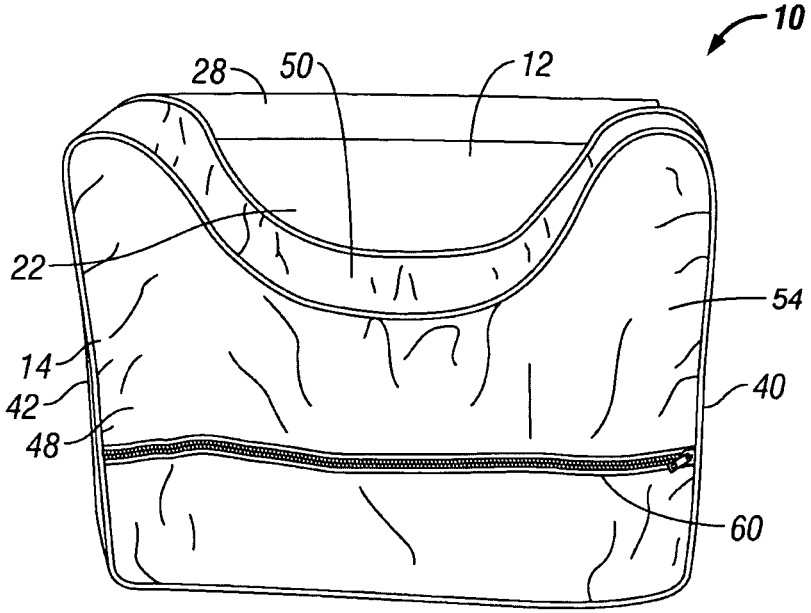
FIG. 3 is yet another perspective view of the pillow system of FIG. 1, also in the storage/carrying mode.

With continued references to FIGS. 1-6, it will now be apparent that the first and second pillows 12 and 14 are dimensioned so when the top panel 22 of the first pillow is placed the inner side panel 46 of the second pillow, the combined pillows assume a "suitcase" shape, that is a parallelogram that is rectangular in each sectional view. That is, since the first and second pillows 12 and 14 have about the same height and width and mating surfaces with complimentary angles, when the first pillow is connected to the second pillow by the strap 62 so that the inner side 30 of the first pillow is adjacent the bottom 52 of the second pillow, the strap serves as a joint therebetween. By providing a handle 78 on the bottom 52 of the second pillow 14, the pillow system 10 can be lifted by the handle, and when lifted, the inner side panel 46 of the second pillow and the top panel 22 of the first pillow 12 hang face-to-face by gravity. Thus, as best seen in FIGS. 1-3, the system 10 thus assembled is in a transport or storage mode. Additionally, in this configuration, the pillow system 10 may serve as a convenient booster seat.

Figure 7:
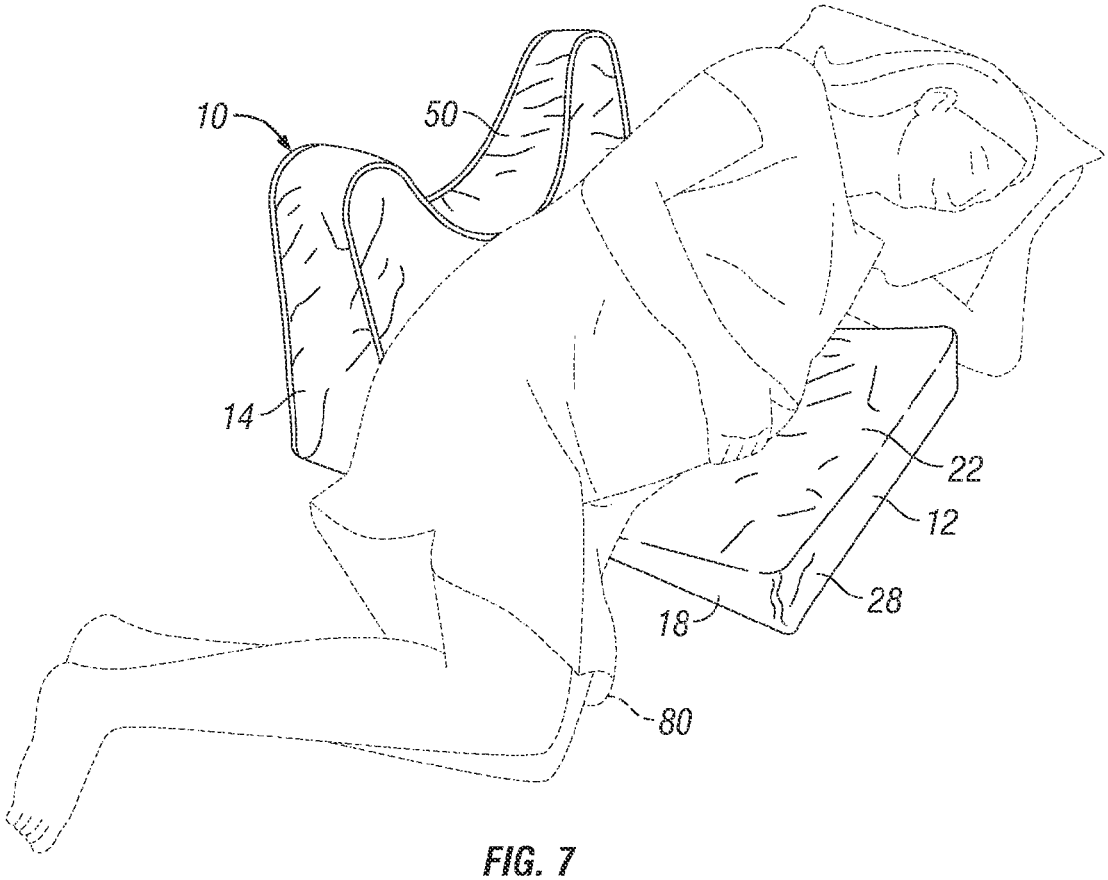
FIG. 7 is a perspective view of the pillow system in use as a support pillow for a pregnant woman, the smaller pillow supporting the abdomen and the larger pillow supporting the back. The pregnant woman is shown in broken lines.

Turning now to FIG. 7, the pillow system 10 in the cradle configuration is employed by a pregnant woman as a prenatal pillow. The woman 80, shown in broken lines, rests on her side, with the first pillow 12 supporting her abdomen and the second pillow 14 supporting her back. This view also illustrates that the curved top 50 of the second pillow 14 reduces the vertical profile of the pillow allowing air to circulate better around the woman 84 for cooling.

Figure 8:
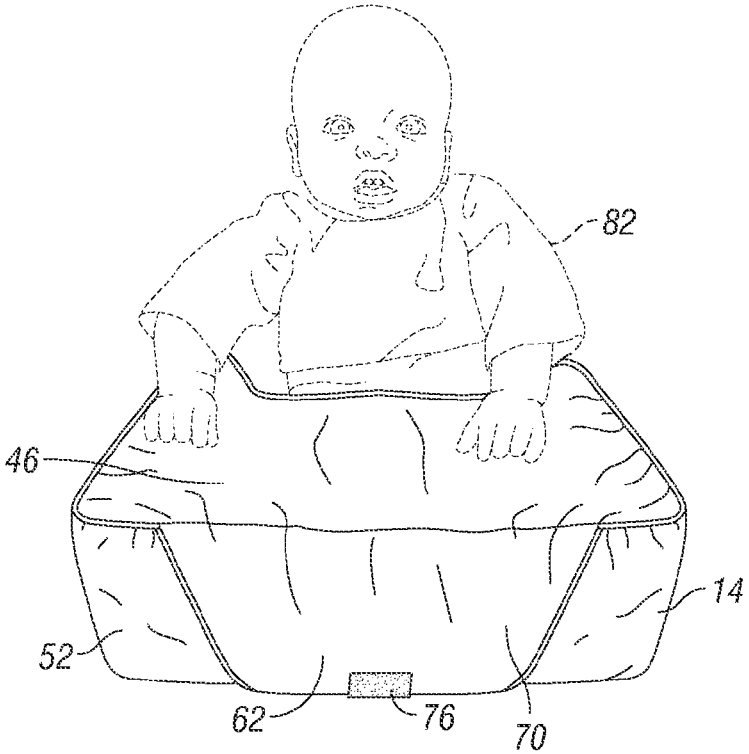
FIG. 8 is a perspective view of the larger pillow of the pillow system being used as a lap tray by a small child. The child is shown in broken lines.

As shown in FIG. 8, a larger infant 82, shown in broken lines, can use the second pillow 14 alone as a comfortable and safe lap tray. The inner panel 46 provides a broad, flat surface for holding toys or snacks.

Figure 9:
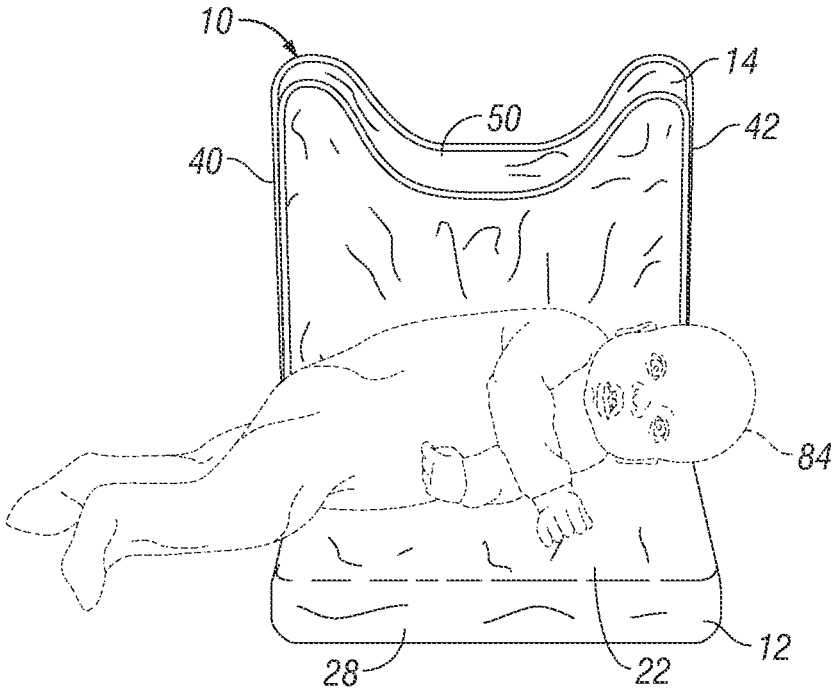
FIG. 9 is a perspective view of the pillow system in use as a support pillow for a sleeping infant, the smaller pillow supporting the abdomen and the larger pillow supporting the back. The infant is shown in broken lines.

FIG. 9 illustrates the pillow system 10 in the "cradle" configuration again, but in this instance it is supporting a small infant 84, shown in broken lines. The larger second pillow 14 supports the infant's back, while the first pillow 12 prevents him from rolling onto his tummy.

Figure 10:
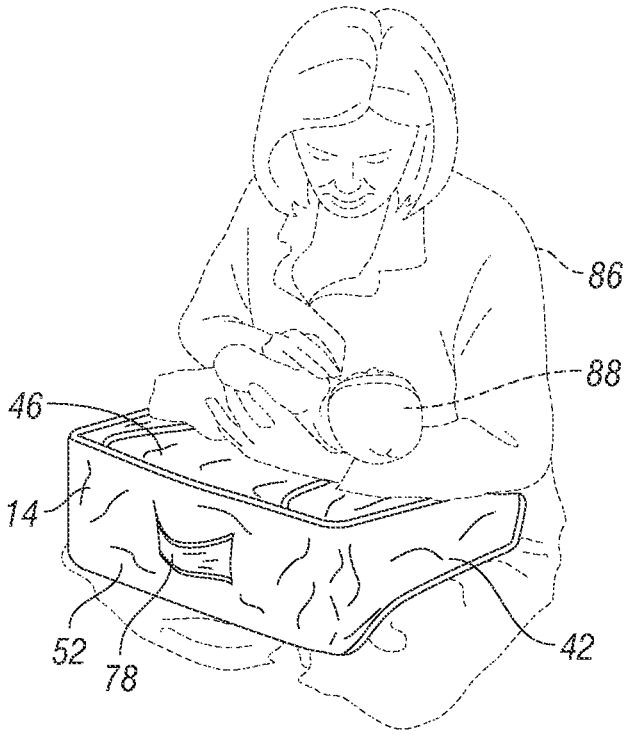
FIG. 10 is a perspective view of the larger pillow of the pillow system in use as a nursing pillow. The mother and child are shown in broken lines.

FIG. 10 shows the second pillow 14 being used as a nursing pillow. The pillow 14 is positioned on the lap of the mother or caregiver 86 so that the curved top panel 50 embraces her waist. The slanted inner side panel 46 supports the infant 88 at a comfortable angle for feeding or for intimate interaction. Now it will be apparent that the user may select whether to have the inner side 46 or the outer side 48 uppermost in her lap, depending on which pitch (degree of slant) is most comfortable. This may vary with the size of the infant or the size of the mother (or caregiver).

Figure 6:
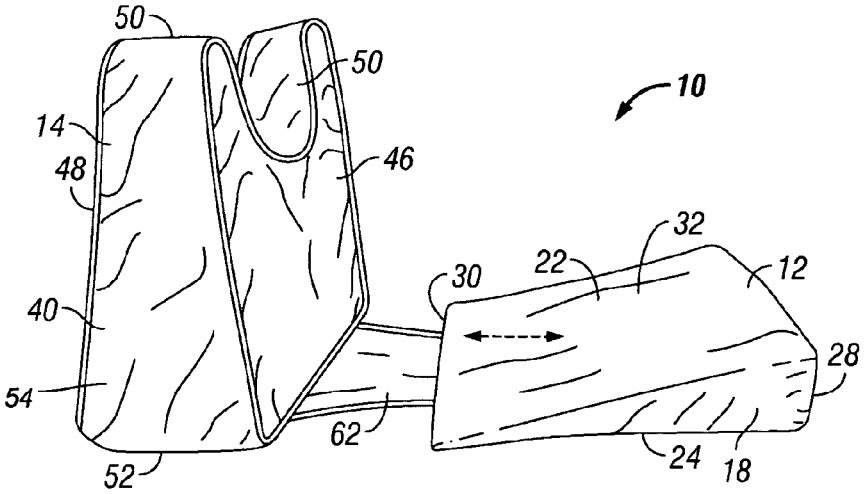
FIG. 6 is a perspective view of the pillow system illustrating how the distance between the two pillows can be adjusted.

As used herein, relative terms, such as "top," "bottom," "inner," and "outer," are used purely to clarify the description and refer to the relative positions of the different elements of the pillow system 10 in the operative position depicted in FIG. 6. It will be understood that the "top" of the second pillow 14 is not always in the top or uppermost position in all possible applications. For example, the top panel 50 of the second pillow 14 in on the side when the pillow is used as a lap pillow as shown in FIG. 8 or a nursing pillow as shown in FIG. 10.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A multi-purpose pillow system comprising:

a first compressible, shape-sustaining pillow defined by opposing first and second triangular end panels joined by top and bottom panels that converge from an outer side panel to a knife-edged inner side;

a second compressible, shape-sustaining pillow defined by opposing first and second end panels joined by inner and outer side panels, an inwardly curved top panel having a width, the width of the top panel being the dimension extending between the inner and outer side panels, and a flat bottom panel disposed opposite the top panel and having a width, the width of the bottom panel being the dimension extending between the inner and outer side panels, the width of the bottom panel being greater than the width of the top panel; and a strap having a first end connected to the first pillow and a second end connected to the second pillow with the knife-edged inner side of the first pillow adjacent the second pillow, wherein the strap is removably and adjustably connected to at least one of the first and second pillows so that the connected position of the first pillow relative to the second pillow is adjustable;

wherein the first and second pillows and the strap are configurable alternately in a first cradle position and a second storage position, wherein in the first cradle position the first pillow is positioned on its bottom panel with the knife-edge inner side facing and spaced a distance from the second pillow, the second pillow is positioned on its bottom panel with the curved top panel facing upwardly and inner side panel facing the first pillow, and the strap is spanning the distance between the first and second pillows.

2. The pillow system of claim 1 wherein the strap has a top surface and a bottom surface and comprises a first fastener member on the top surface near the first end, and wherein the first pillow comprises a second fastener member on the bottom panel engageable with the first fastener member whereby the strap is removably and adjustably connected to the first pillow.

3. The pillow system of claim 2 wherein the second end of the strap is permanently connected to the second pillow.

4. The pillow system of claim 2 wherein the pillow system further comprises a handle, wherein the first and second pillows have about the same height and width so that, when the first pillow is connected to the second pillow and the knife-edge inner side is adjacent the bottom panel of the second pillow, the strap serves as a joint therebetween so that, when the pillow system is lifted by the handle, the inner side panel of the second pillow and the top panel of the first pillow hang face-to-face in the storage position.

5. The pillow system of claim 4 wherein the pillows comprise removable covers.

6. The pillow system of claim 4 wherein the first fastener is a strip of hook-and-loop fastener and wherein the second fastener member is a strip of hook-and-loop fastener.

7. The pillow system of claim 4 wherein the handle is positioned on the bottom panel of the second pillow.

8. The pillow system of claim 1 wherein the outer side panel of the first pillow is flat.

9. The pillow system of claim 1 the strap is attached to the second pillow where the bottom panel adjoins the inner side panel.

10. The pillow system of claim 1 wherein in the second pillow the angle formed by the plane of the inner side panel relative to the plane of the bottom panel is greater than the angle formed by the plane of the outer side panel relative to the bottom panel.

* * * * *

UNITED STATES PATENT AND TRADEMARK OFFICE

CERTIFICATE OF CORRECTION

PATENT NO. : 8,671,480 B1
APPLICATION NO. : 11/849431
DATED : March 18, 2014
INVENTOR(S) : Jamie S. Leach It is certified that error appears in the above-identified patent and that said Letters Patent is hereby corrected as shown below:

In the Specification

Column 2, line 29: replace “as solid” with --as a solid--.
Column 2, line 33: replace “may used” with --may be used--.
Column 2, line 64: replace “by plane” with --by the plane--.

Column 3, line 5: replace “as solid” with --as a solid--.
Column 3, line 9: replace “may used” with --may be used--.
Column 3, line 59: replace “placed the” with --placed in the--.

Column 4, line 42: replace “in” with --is--.
Column 4, line 50: replace “inventions” with --invention--.
Column 4, line 53-54: replace “inventions” with --invention--.

In the Claims

Claim 6, Column 6, line 17: replace “fastener is” with --fastener member is--.
Claim 9, Column 6, line 24: replace “claim 1 the” with --claim 1 wherein the--.

Signed and Sealed this
Second Day of September, 2014

Michelle K. Lee

Michelle K. Lee
*Deputy Director of the United States Patent and Trademark Office*